United States Patent [19]

Blomqvist et al.

[11] Patent Number: 4,538,986

[45] Date of Patent: Sep. 3, 1985

[54] MEANS FOR SUPPORTING THE MATERIAL UNDER TREATMENT IN CONTINUOUS-ACTION HEAT TREATMENT FURNACES

[75] Inventors: Seppo I. Blomqvist, Tornio; Markku T. Saarela; Martti E. Huhtala, both of Kokkokangas; Raimo A. Niska, Tornio; Hannu A. Vaittinen, Espoo, all of Finland

[73] Assignee: Outokumpu Oy, Helsinki, Finland

[21] Appl. No.: 571,868

[22] Filed: Jan. 18, 1984

[30] Foreign Application Priority Data

Jan. 27, 1983 [FI] Finland ..... 830284

[51] Int. Cl.[3] ..... F27D 3/00; F27D 1/16; F27B 9/28

[52] U.S. Cl. ..... 432/236; 432/3; 432/59; 432/246

[58] Field of Search ..... 432/3, 236, 246, 59

[56] References Cited

U.S. PATENT DOCUMENTS

| | | | |
|---|---|---|---|
| 4,049,372 | 9/1977 | Bloom | 432/246 |
| 4,069,008 | 1/1978 | Bloom | 432/59 |
| 4,217,090 | 8/1980 | Whike et al. | 432/59 |

FOREIGN PATENT DOCUMENTS

| | | | |
|---|---|---|---|
| 56-46989 | 4/1981 | Japan | 432/246 |

*Primary Examiner*—John J. Camby

*Attorney, Agent, or Firm*—McAulay, Fields, Fisher, Goldstein & Nissen

[57] ABSTRACT

The invention concerns a means for supporting the material being treated in continuous-action heat treatment furnaces. The support means consists of a cooled roller (5), on the periphery of which at least two cooled rollers (7) with substantially smaller diameter have been placed. The roller (5) is placed outside the furnaces (13, 16) and/or between two consecutive furnaces. Supporting of the material (18) is carried out by the aid of one roller (7) at a time, the roller (7) rotating at the speed of moving of the material. By the aid of the drive (3) provided for the roller (5), the mutual positioning of the rollers (7) can be changed.

20 Claims, 4 Drawing Figures

(A-A)

MEANS FOR SUPPORTING THE MATERIAL UNDER TREATMENT IN CONTINUOUS-ACTION HEAT TREATMENT FURNACES

FIELD OF THE INVENTION

The present invention concerns a means for supporting the material under treatment in continuous-action heat treatment furnaces where the supporting of the material is accomplished with water-cooled, revolver-type sets of support rollers located substantially outside the furnace.

BACKGROUND OF THE INVENTION

When subjecting metal objects to heat treatment in a continuous operation, such as sheet-iron strip for instance, it is common practice to use as support for the material under treatment, at the openings of the furnaces, and if necessary, between furnaces, roller sets in which two alternatingly operating rollers have been placed side by side. It is then possible to lift each roller by itself into operating position or to lower it into the changing position. A drawback is the great height required in the openings of the furnaces, because the sag of the strip's catenarian curve is different according to whether the roller doing the supporting is that closer to the opening or that lying farther away. It is also a fact that the strip between furnaces cools, and sealing of the openings is difficult, whereby considerable energy losses are incurred.

For supporting the material in continuous-action heat treatment furnaces there has also been used a water-cooled support roller set pushable into the furnace through its side. In this case, the support roller set is in the hot furnace throughout the operating time, whereby its service life is significantly curtailed. In addition, the replacing of a single roller is inconvenient, and the material is highly susceptible to scoring. Furthermore, sealing of the opening of the furnace is difficult.

OBJECTS AND SUMMARY OF THE INVENTION

The object of the present invention is to eliminate the drawbacks of prior art and to provide a more energy-conservative and more reliable support roller set suitable for supporting the material in continuous-action heat treatment furnaces and by the aid of which the sag of the material can be maintained substantially constant even in connection with roller replacement and thus the openings of the furnaces can be sealed in the most perfect manner, considering the circumstances.

The support means of the invention consists of a large water-cooled roller on the periphery of which have been placed at least two water-cooled rollers substantially smaller in diameter and mutually substantially equal in size. When one wishes to change the roller, the large diameter roller is rotated through the distance required to bring a new smaller diameter roller into supporting position. Thereby, as the supporting circle is substantially unchanged during the alteration, the sag of the material being supported will also remain substantially unchanged. Furthermore, the old roller that was in use can rapidly be replaced by another even while the treatment of material is going on.

When the support means of the invention is employed, the openings of the heat treatment furnaces may be carried out with fixed structures and small in size, thereby minimizing the leakage air flows because the sag of the material under treatment can be kept substantially constant all the time. In addition, if two or more heat treatment furnaces are needed in succession, the furnaces can be built to be contiguous, whereby the total length can be reduced and the number of openings can be made less. The cooling between furnaces also becomes less. Furthermore, the heat treatment furnaces can be connected one to the other so that only one exhaust duct is needed, whereby the hot gas can be made to flow against the material being treated. Thereby, the heat transfer is improved, and the temperature of the exhaust gases can be lowered.

BRIEF DESCRIPTION OF THE DRAWINGS

The means of the invention and its operation are described in the following in greater detail, referring to the drawings attached, wherein.

DISCLOSURE OF BEST MODE

Figure 1:
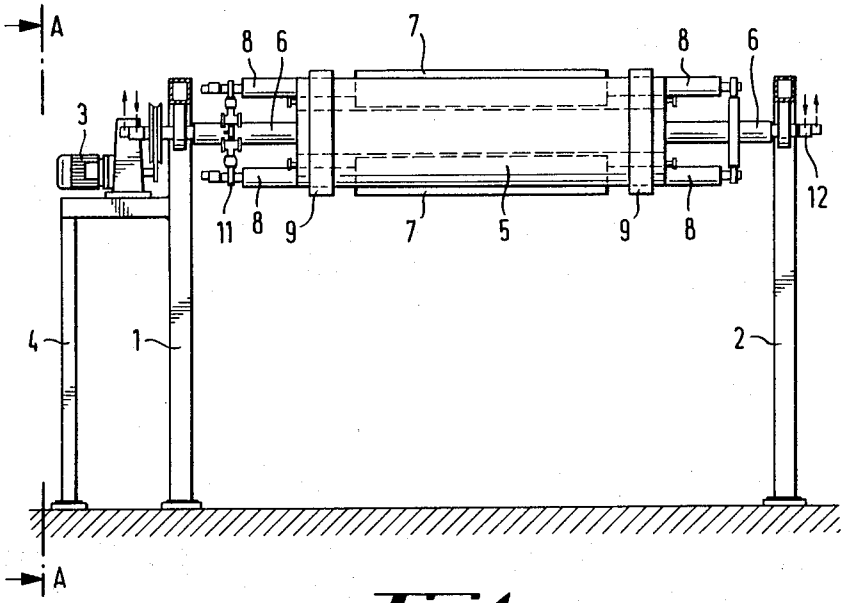
FIG. 1 illustrates an advantageous embodiment of the means of the invention in longitudinal projection.
Figure 2:
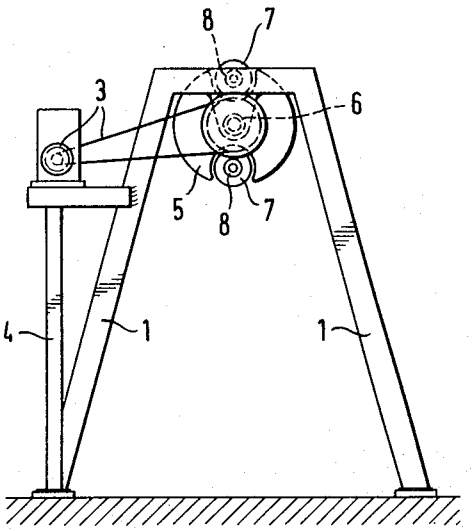
FIG. 2 shows the elevational view of the embodiment of FIG. 1, viewed in the direction A—A.

As shown in FIG. 1, the means of the invention is carried with the aid of supports 1,2, similarly as a drive 3 for the means is also carried with the aid of a support 4. A large diameter roller 5 is mounted by its central shaft 6 on supports 1,2. The small diameter rollers 7 provided on the periphery of the roller 5 are mounted by their central shaft 8 in support parts 9 on the ends of the roller 5. The cooling water is conducted into cooling pipes 10 provided in the rollers 7 and around the central shaft of the roller 5 (FIGS. 3 and 4) through a rotary member 11, while the cooling water is carried through a rotary member 12 into the cooling pipes of central shaft 6 of the roller 5.

Figure 3:
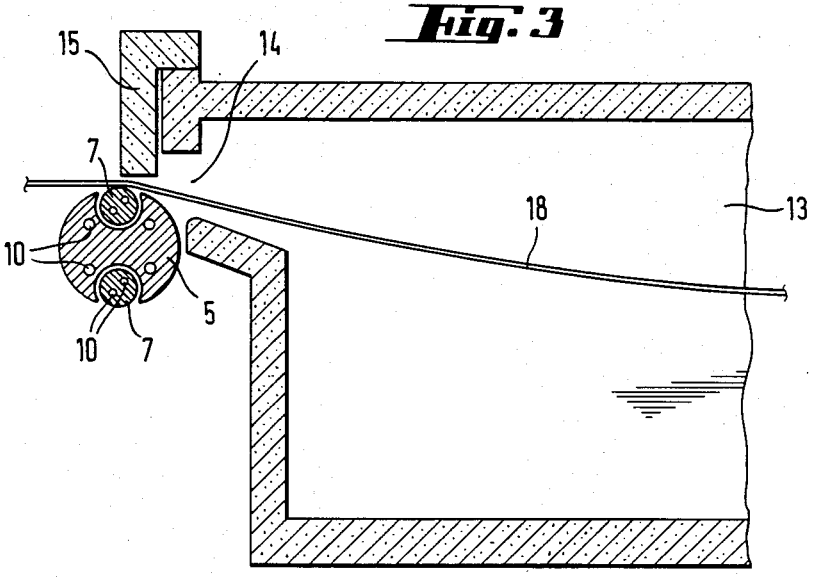
FIG. 3 shows schematically in elevational view an advantageous way of placing the embodiment of FIG. 1 in the opening of a heat treatment furnace.
Figure 4:
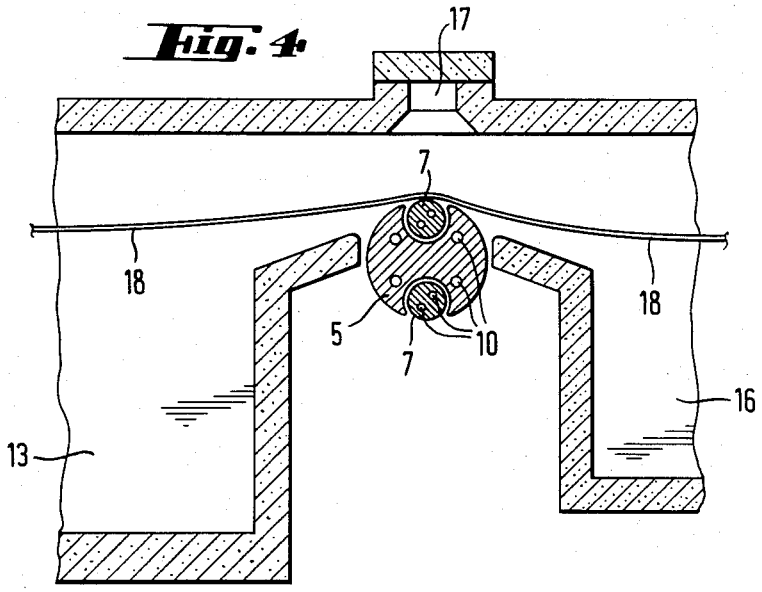
FIG. 4 shows schematically in elevational view an advantageous placement of the embodiment of FIG. 1 between two consecutive heat treatment furnaces.

As shown in FIG. 3, when the support means 5 of the invention is placed into the opening 14 of the heat treatment furnace 13, the size of the opening 14 can be reduced by substantially fixed structures 15. Similarly, when the support means 5 of the invention is placed between two heat treatment furnaces 13, 16 (FIG. 4), furnaces 13, 16 can be placed substantially close together. As shown in FIG. 4, the flue gases from the furnace 13 may be voided through an aperture 17, if necessary.

When the support means of the invention is used in connection with the heat treatment of the material 18 being supported, the topmost roller 7 rotates at the same speed at which the material moves forward. When it is desired to exchange the roller 7 in supporting position against another equivalent roller 7, the drive 3 is operated to rotate the large roller 5 in the direction in which the material is moving and substantially at the speed of the material so as to bring the new roller 7 into supporting position. The roller 7 which was in supporting position can thereafter be exchanged without interrupting the heat treatment. When the support roller 7 which had been in use is being replaced, the rotary member 11 may be used to cut the water cooling of the roller 7 that is being replaced out of the cooling circuit, whereas the other part of the rollers 5 and 7 remain connected. After the new roller 7 has been changed it may be cut in again in the cooling circuit by means of the valve assembly 1, without causing any adverse effect to the other components. It is also possible to install the roller 5 and the rollers 7 each in a cooling circuit of their own, or in such a way that every roller 5, 7 lies in a different cooling circuit.

We claim:

1. A support for supporting material under treatment in a continuous action heat-treatment furnace having an entrance opening, comprising:

a first roller having at least two spaced recesses;

at least two other rollers on the periphery of said first roller, the diameter of said first roller being greater than the sum of the diameters of each of said other rollers, one of said other rollers being received in each of said recesses rotatable about their own individual axis and revolvable with said first roller about its axis thereof;

a support for said first roller independent of said furnace for supporting said rollers substantially outside said furnace at said entrance opening; and cooling means associated with each of said rollers.

2. The support of claim 1, including means to move each of said rollers into position supporting the material as it is fed into the entrance of said furnace such that a topmost one of said other two rollers rotates at the same speed as the feed of the material and to move said one roller into position to permit rotation thereof at the speed of the feeding material to move said topmost of said other two rollers out of position beneath the material for changing said topmost roller and moving the other of said two other rollers into the topmost position.

3. The support of claim 1, further including drive means associated with said first roller and arranged to change the mutual position of said other rollers.

4. The support of claim 1, wherein support of said material is effected by one of said rollers which is in topmost position.

5. The support of claim 1, wherein said first roller is located substantially close to the opening of said furnace.

6. The support of claim 1, wherein said first roller is placed between two consecutive furnaces.

7. The support of claim 1, wherein each of said rollers is associated with a different cooling circuit.

8. The support of claim 7, wherein said roller in the topmost position rotates at substantially the same speed at which said material moves forward.

9. The support of claim 1, wherein said other rollers have substantially equal diameters.

10. The support of claim 1, wherein said other rollers are positioned substantially symmetrically in relation to one another.

11. A support for supporting material under heat treatment in a continuous action heat-treatment furnace having an entrance opening, comprising:

a three roller combination together having an outer substantially continuous surface, one of the rollers forming said three roller combination having a diameter greater than the sum of the diameters of the other two rollers forming, and said one roller having recesses at the periphery for receiving the other two rollers;

a support for said one roller independent of said furnace for supporting said rollers substantially outside said furnace at said entrance opening;

means to rotate said roller combination such that when said one roller or either of said two other rollers are supporting material moving into said furnace the individual one of said other rollers rotates at the same speed at which the material moves into said furnace; and means for cooling each of said rollers.

12. The support of claim 11, including means for moving said three roller combination at the same time as the material moves into said furnace to move one of said other two rollers for changing thereof out of engagement with and support of the material prior to moving the other of said two rollers into engagement with and support of the moving material for support thereof.

13. The support of claim 12, including drive means, a central shaft coupled to said drive means and associated with said one roller for changing the mutual position of said other rollers.

14. The support of claim 11, including support parts on the ends of one first roller mounting said one roller to said support and a central shaft for each said two other rollers for mounting said other rollers to said first roller.

15. The support of claim 11, including a first cooling circuit associated with said one roller, and a second cooling circuit associated with said other rollers.

16. The support of claim 12, including support parts on the ends of said one roller and a central shaft for each said two other rollers for mounting said other rollers to one first roller.

17. The support of claim 11, wherein said three roller combination is sized for placement in an opening at the entrance to the furnace with one of said other two rollers in contact with the material moving through the furnace.

18. The support of claim 17, including drive means, one central shaft for said one roller coupled to said drive means for changing the mutual position of said other rollers, separate other central shafts for each said two other rollers for mounting said other rollers to said one roller, a first cooling circuit associated with said one roller and a second independent cooling circuit independent of said first cooling circuit independently associated with each said other rollers.

19. The support of claim 18, including a rotary member associated with said other rollers for carrying cooling water to said second cooling circuit.

20. The support of claim 11, wherein said at least two spaced recesses are diametrically spaced from each other and the included angles therebetween are equal, and said at least two other rollers are received within said recesses and a line connecting their center with the center of said first roller are substantially equal.

* * * * *